US008403035B2

(12) United States Patent
Akselberg et al.

(10) Patent No.: US 8,403,035 B2
(45) Date of Patent: Mar. 26, 2013

(54) SEALING AND ANCHORING DEVICE FOR USE IN A WELL

(75) Inventors: Frank Akselberg, Sandnes (NO); Per Olav Haughom, Tonstad (NO)

(73) Assignee: I-Tec AS, Stavanger (NO)

( * ) Notice: Subject to any disclaimer, the term of this patent is extended or adjusted under 35 U.S.C. 154(b) by 619 days.

(21) Appl. No.: 12/530,349

(22) PCT Filed: Feb. 27, 2008

(86) PCT No.: PCT/NO2008/000074

§ 371 (c)(1),
(2), (4) Date: Oct. 21, 2009

(87) PCT Pub. No.: WO2008/111843

PCT Pub. Date: Sep. 18, 2008

(65) Prior Publication Data

US 2010/0038072 A1 Feb. 18, 2010

(30) Foreign Application Priority Data

Mar. 9, 2007 (NO) ..... 20071304

(51) Int. Cl.
*E21B 23/00* (2006.01)
*E21B 33/12* (2006.01)

(52) U.S. Cl. ..... 166/118; 166/179; 166/206; 166/195

(58) Field of Classification Search ..... 166/134, 166/118, 179, 196, 206
See application file for complete search history.

(56) References Cited

U.S. PATENT DOCUMENTS

| | | | | |
|---|---|---|---|---|
| 1,459,368 | A * | 6/1923 | Henshaw et al. | 166/105.6 |
| 3,066,739 | A * | 12/1962 | Saurenman et al. | 166/141 |
| 3,314,479 | A * | 4/1967 | McCullough et al. | 166/63 |
| 3,703,904 | A * | 11/1972 | McClinton | 137/504 |
| 4,302,018 | A | 11/1981 | Harvey et al. | |
| 4,324,407 | A | 4/1982 | Upham et al. | |
| 4,424,865 | A * | 1/1984 | Payton, Jr. | 166/302 |
| 4,501,327 | A * | 2/1985 | Retz | 166/285 |
| 5,335,723 | A * | 8/1994 | Mouton | 166/173 |
| 6,098,986 | A * | 8/2000 | Nowak | 277/345 |
| 6,296,054 | B1 | 10/2001 | Kunz et al. | |

(Continued)

FOREIGN PATENT DOCUMENTS

| | | |
|---|---|---|
| JP | 2007-32641 | 2/2007 |
| WO | 81/02457 | 9/1981 |

(Continued)

OTHER PUBLICATIONS

International Search Report dated Jun. 11, 2008 for International Application No. PCT/NO2008/000074.

(Continued)

*Primary Examiner* — Jennifer H Gay
*Assistant Examiner* — Michael Wills, III
(74) *Attorney, Agent, or Firm* — Wenderoth, Lind & Ponack, L.L.P.

(57) ABSTRACT

A sealing and/or anchoring element for use in pipelines. The sealing and/or anchoring element includes at least one helical element disposed around a string section, with the helical element being configured so as to be able to expand radially towards an inner wall of the pipeline as the circumferential diameter thereof is increased.

31 Claims, 8 Drawing Sheets

U.S. PATENT DOCUMENTS

| | | | | |
|---|---|---|---|---|
| 6,318,461 | B1 | 11/2001 | Carisella | |
| 7,363,970 | B2 * | 4/2008 | Corre et al. | 166/187 |
| 7,392,988 | B2 * | 7/2008 | Moldt et al. | 277/429 |
| 7,673,692 | B2 * | 3/2010 | Kunz | 166/387 |
| 7,909,109 | B2 * | 3/2011 | Angman et al. | 166/387 |
| 7,997,337 | B2 * | 8/2011 | Kunz | 166/187 |
| 2005/0000692 | A1 * | 1/2005 | Cook et al. | 166/300 |
| 2005/0217850 | A1 | 10/2005 | Cho et al. | |

FOREIGN PATENT DOCUMENTS

| | | |
|---|---|---|
| WO | 02/04783 | 1/2002 |

OTHER PUBLICATIONS

Written Opinion of the International Searching Authority dated Jun. 11, 2008 for International Application No. PCT/NO2008/000074.

* cited by examiner

SEALING AND ANCHORING DEVICE FOR USE IN A WELL

BACKGROUND OF THE INVENTION

I. Technical Field

The present invention relates to a sealing element for use in a well and, more particularly, to a radially and axially expandable element having an especially large expansion rate in order to be able to be expanded radially against an inner wall of a pipeline.

The present invention is particularly, although not exclusively, suitable for use in oil and gas wells for providing a packer having a large expansion rate. In particular, the present invention allows for the provision of a metal-to-metal seal, but is also very well suited for providing an elastomer seal. Also, the present invention will be very well suited for use as an anchoring element against an inner wall of a pipe, such as in a pipeline, for example, and in that case advantageously in combination with the sealing element function.

II. Description of the Related Art

Frequently, it is desirable to be able to install a pressure tight plug or seal in an oil or gas well in order to isolate adjacent production zones from each other. In many cases, it will be necessary for such a plug or seal to have a relatively large rate of expansion, as the plug or seal is typically run through restrictions having a smaller diameter than the one within which the plug is to set before the plug or seal reaches the location at which it is to be set.

Currently, several alternative functional elastomer sealing elements providing a high expansion rate are available. In general, however, such alternatives have the disadvantage of having an insufficient pressure capacity, especially when the expansion rates are high. Additionally, such elastomer sealing elements are often difficult to release after use as the large expansion to which the elastomer sealing elements have been subject causes severe deformations of the elastomer material, which needs a long time to restore its original shape, i.e. retract.

SUMMARY OF THE INVENTION

It is recognized that metal-to-metal seals, or so-called metal seals, provide the closest and most compact seals and anchors. However, it is a major problem that metals have a limited ability to expand (ductility) before fracture occurs. An example of a metal-to-metal seal that suffers from such problems is disclosed in WO0204783.

JP 2007032641 relates to a pipe plugging device comprising a helical sealing element that may be manipulated using a combination of an axial load and a screw load in order to vary the radial extension thereof.

U.S. Pat. No. 6,296,054 relates to a device for the internal plugging of pipes or wellbores. The device comprises a number of helical metallic strips being arranged around an inner string section. The strips form a cylindrical cage/framework which is then used for supporting one or more sealing elements.

U.S. Pat. No. 6,318,461 relates to a device for the internal plugging of pipes or wellbores. The device comprises helical sealing elements being arranged around a string section. A combination of an axial load and a screw load will help in the varying of the radial extension of the device.

WO 02/04783 relates to a device for the internal plugging of pipes or wellbores.

Moreover, in general, metal seals are much more sensitive with respect to the seal face, that is, the inside of the pipe in which the packer is set. Grooves and scratches on the inner surface of the pipe may quickly result in leaks, to a much greater extent than in the case of elastomer packers.

Also, high expansion rates will present a challenge in connection with the anchoring of the plug to a pipe wall, and such anchoring devices typically involve complex mechanisms including a lot of moveable parts.

The object of the present invention is to provide a sealing and/or anchoring element that does not suffer from the above disadvantages.

The present invention achieves its objects by providing a sealing system that, inter alia, supports the sealing element all the way to the pipe wall, provides equally high expansion rates for metal sealing elements as for elastomer packer elements, includes very few moveable parts but still has a large gripping area on the pipe wall to minimize the point loads, and that provides great flexibility with respect to the sealing width, so that the chance of achieving a successful metal-to-metal seal is increased.

According to the present invention, the above and other objects are achieved by a device that is characterized in the features set forth in the independent claim 1. Further advantageous embodiments are set forth in the dependent claims.

BRIEF DESCRIPTION OF THE DRAWINGS

In the following, a detailed description of advantageous embodiments and non-limiting examples of the present invention is given, with reference to the accompanying drawings, in which:

FIG. 2A shows a plug 3 before the sealing and anchoring system has been expanded within pipe 1, whereas FIG. 2B shows the sealing and anchoring system in an expanded position.

FIG. 3A shows a string section 10 provided with a chamber 10*a* for an elastic medium (theoretically, chamber 10*a* could be filled with water, provided that the volume is sufficient). At one end, string section 10 is provided with an abutment profile 10*c* shaped so as to adequately support a sealing system 5 in the position shown in FIGS. 3B and 3C. The other end of string section 10 includes a profile 10*b*, so that axial forces may be applied to string section 10. Helical elements 5*a* and 5*b* extend coaxially on the outside of string section 10.

DETAILED DESCRIPTION OF THE INVENTION

Figure 3A:
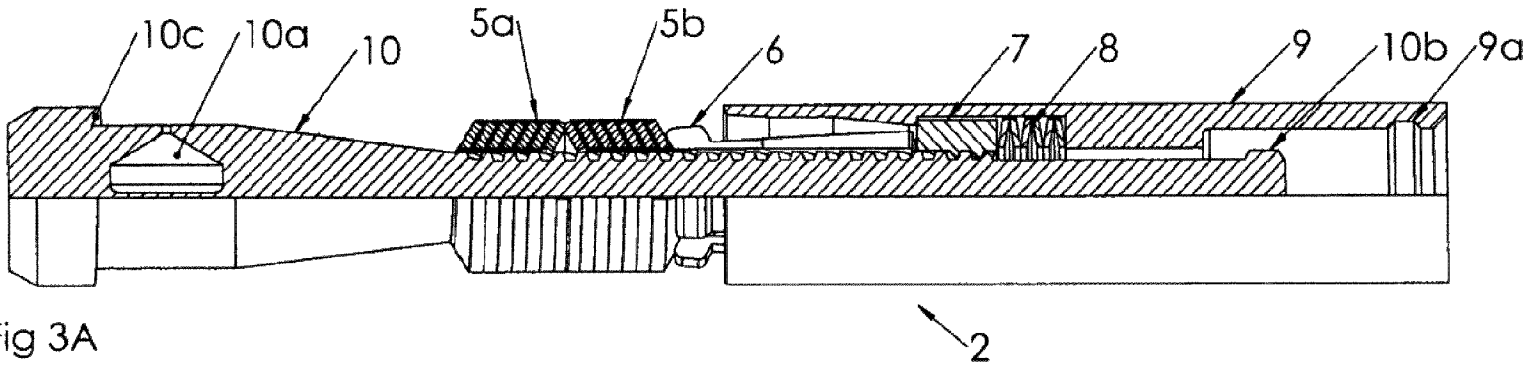
FIGS. 3A, 3B, and 3C show an exemplary embodiment of the present invention, which embodiment implements a sealing system.
Figure 3B:
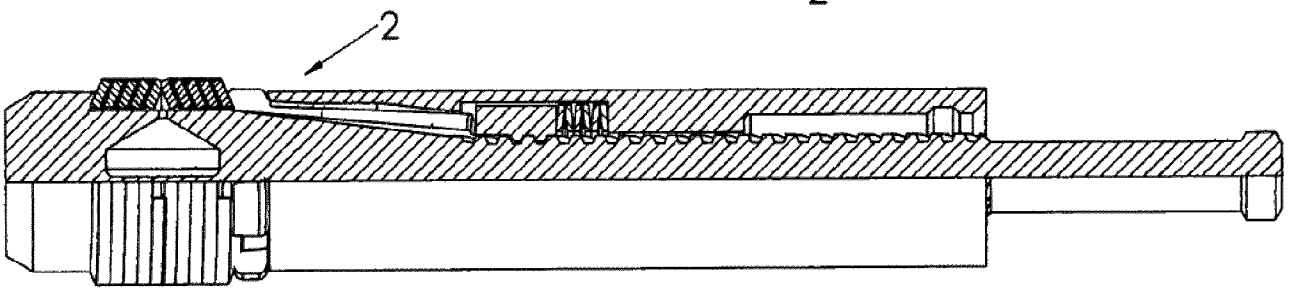
Figure 3C:
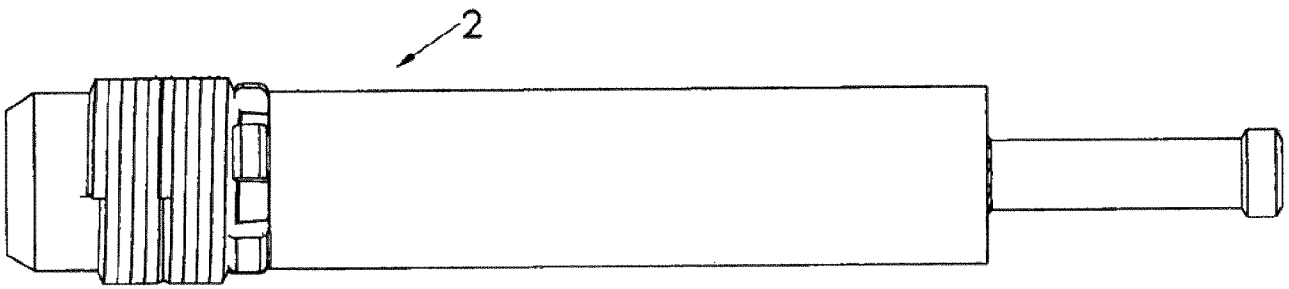

FIGS. 3A-C show a plug 2 comprising helical elements 5*a* and 5*b*, wherein to the one end of the helical element 5*b*, a set of expandable fingers 6 has been attached, each being supported in a bearing body 7. Fingers 6 are designed so as to be able to tilt outwards as shown in FIG. 3B. Fingers 6 are shaped in such a manner that each finger will be positioned against the helical element 5 when this is expanded as shown in FIG. 3B. Additionally, one of fingers 6 is also fixed to the one end of the helical element 5*b*, so that twisting and pulling forces may be transferred thereto (cf. FIG. 7). In this embodiment, bearing body 7 is provided with an inner threaded/screwed cogging that engages a corresponding cogging on string section 10. On an axial relative movement between string section 10 and bearing body 7, a simultaneous relative rotation between string section 10 and bearing body 7 will be effected.

It is understood that string section 10 may include a through bore.

FIG. 3A also shows a compression sleeve 9 surrounding string section 10, fingers 6, and bearing body 7. Compression sleeve 9 will be axially connected to bearing body 7, along with a spring element 8. This will allow axial forces applied in both directions to be transferred to the one end of the helical element 5 from compression sleeve 9. Compression sleeve 9 has a gripping profile 9*a* in the one end thereof, so that a suitable tool may engage gripping profile 9*a* to transfer axial forces to compression sleeve 9.

A spring element 8 will be able to compress sufficiently to allow the relative position between bearing body 7 and compression sleeve 9 to become as shown in FIG. 3B, which shows that compression sleeve 9 is abutted against fingers 6 so that compressive forces may be transferred directly and bypass bearing body 7.

Figure 7:
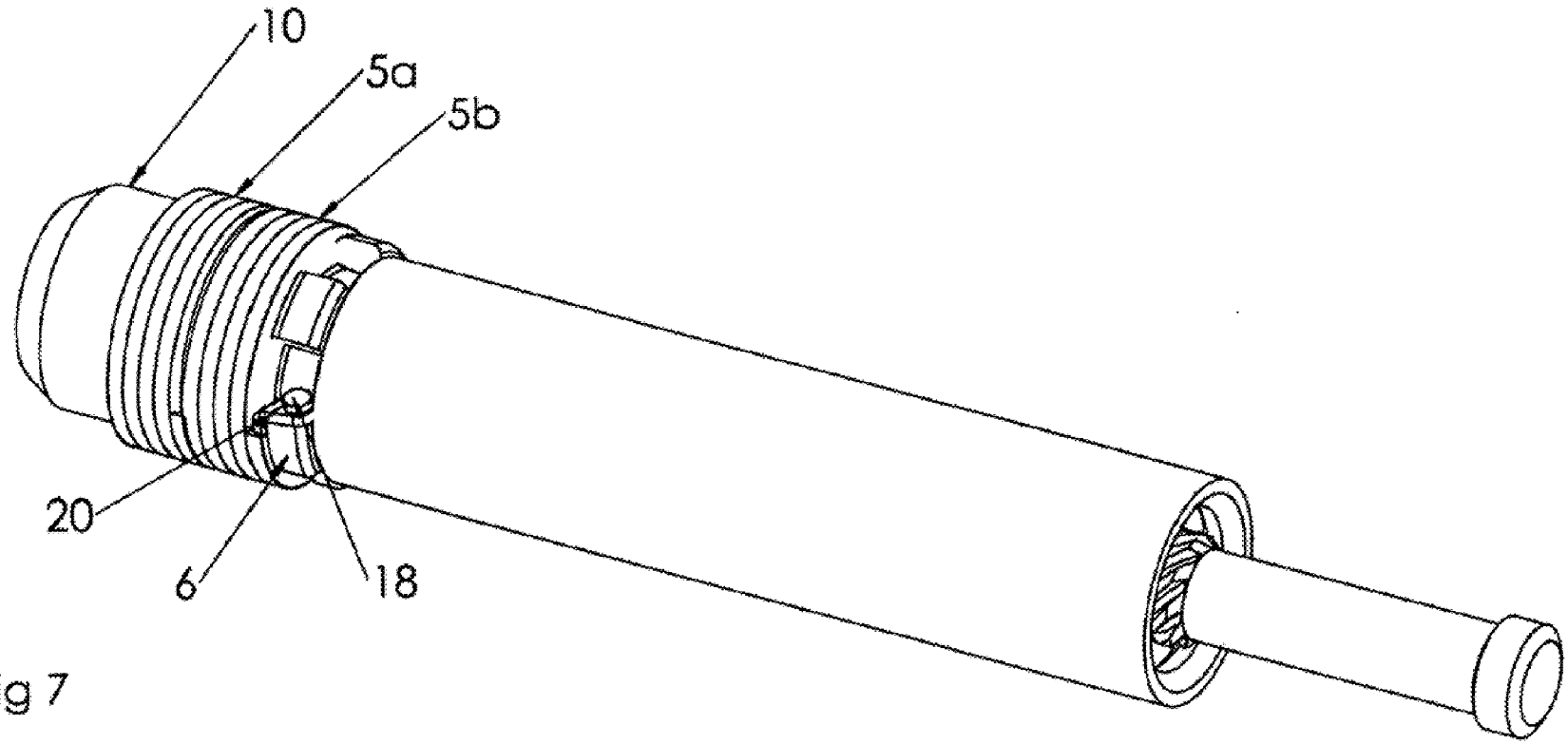
FIG. 7 shows an embodiment comprising an integrated sealing system 5*a* and 5*b*, wherein a sealing system component 5*b* is fixed to a finger 6 by way of a bolt 18 and a lug 20.

FIG. 7 shows a manner in which a sealing system component 5*b* may be fixed to the fingers 6 by a bolt 18 through a lug 20 in 5*a*.

The helical elements 5*a* and 5*b* form sealing elements/devices. When axial forces are applied to string section 10 and compression sleeve 9, the helical elements 5*a* and 5*b* will be driven up the conical part of string section 10 while at the same time a relative rotation between the string section 10 and helical elements 5*a* and 5*b* will occur. The rotational direction is chosen so that the helical elements 5*a* and 5*b* are subject to twisting forces against the winding direction of the helical elements, with the twisting force contributing to extend/expand the helical elements 5*a* and 5*b*. The extension/expansion of the helical elements 5*a* and 5*b* helps facilitating the climbing thereof up the conically shaped part of string section 10. Spring element 8 is chosen so that the spring force thereof at all times will exceed the frictional forces occurring when sealing elements 5*a* and 5*b* are pushed upwards the conical part of string section 10.

Figure 1A:
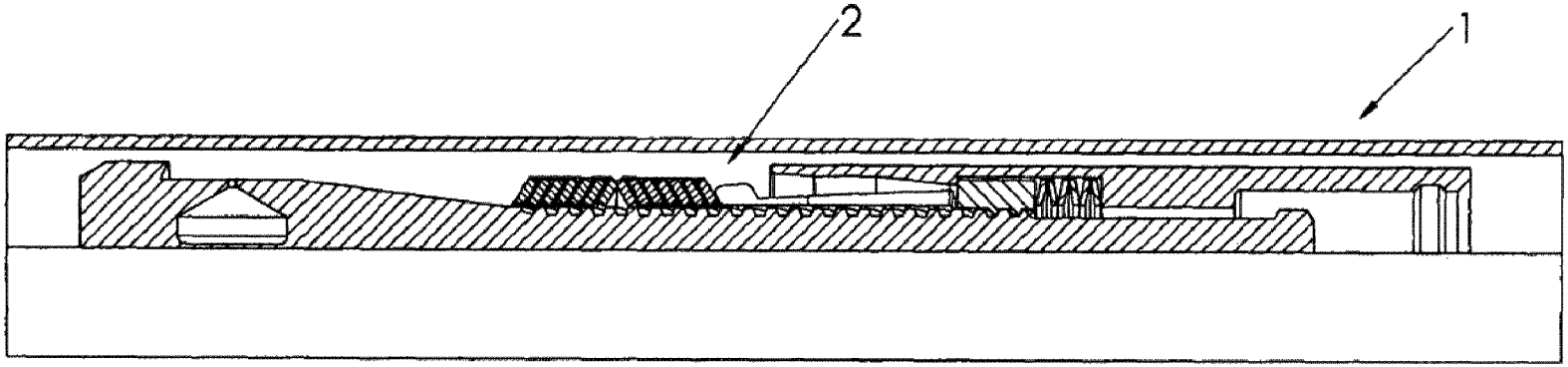
FIGS. 1A and 1B show a design for utilizing the present invention as a double-acting sealing system, with FIG. 1A showing a plug 2 before the expansion of helical elements inside a pipe 1 and FIG. 1B showing the plug 2 inside pipe 1 in an expanded position.
Figure 1B:
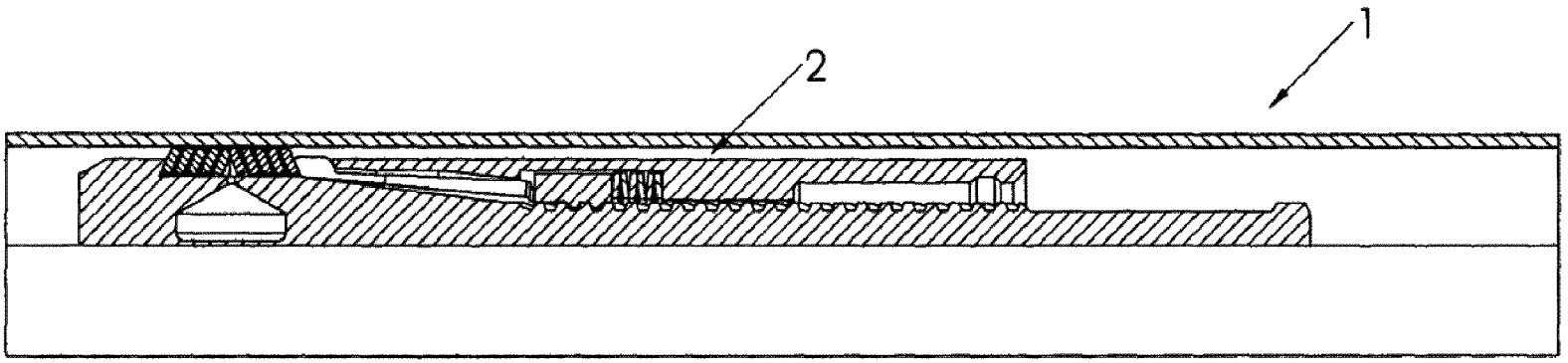
Figure 2A:
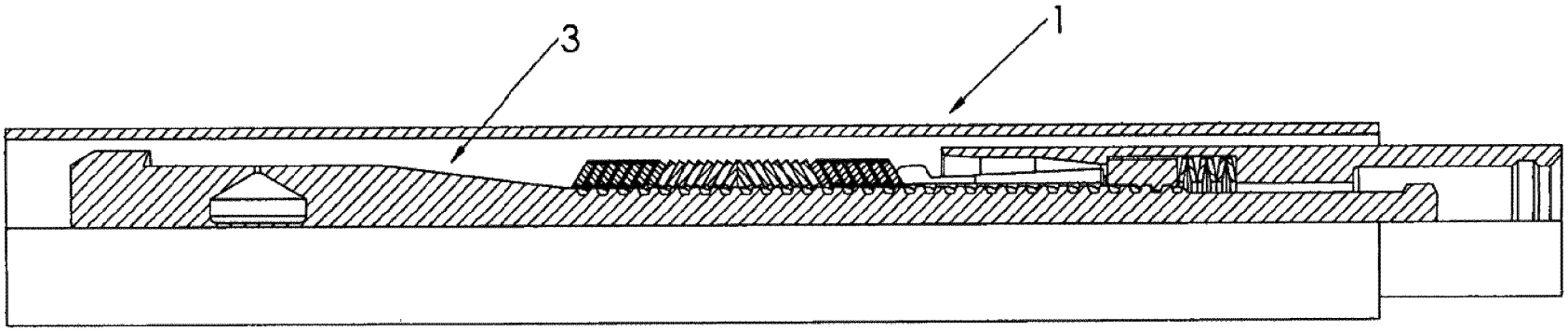
FIGS. 2A and 2B show an alternative design for an application of the present invention, with this embodiment comprising a combination of a sealing system and an anchoring system.
Figure 2B:
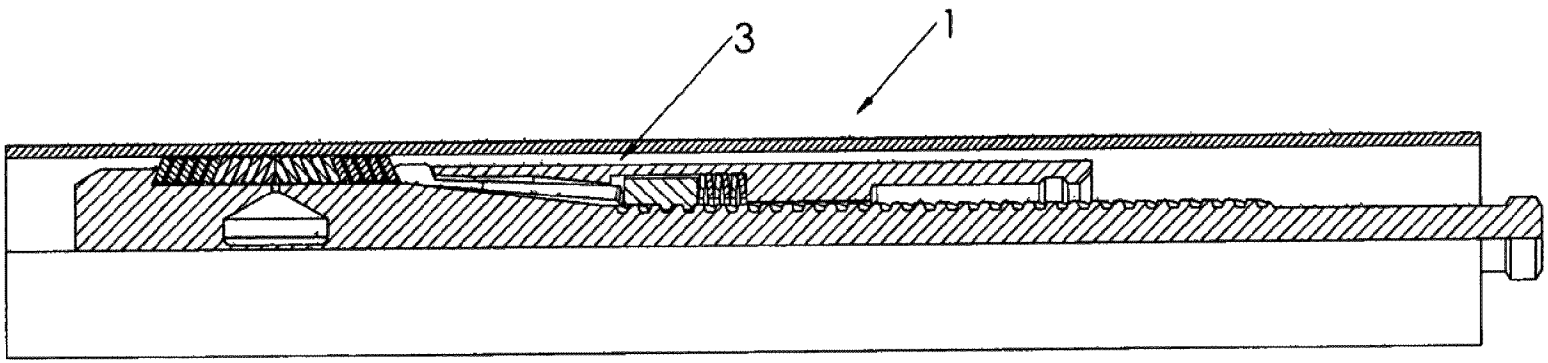

When sealing elements 5*a* and 5*b* has been pushed to abutment against a contact surface 10*c*, spring element 8 will compress further and compression sleeve 9 will be brought to bear against fingers 6. In this manner, large axial compressive forces may be transferred to sealing elements 5*a* and 5*b* without applying any load to bearing body 7 and fingers 6. When large axial compressive forces are applied to sealing elements 5*a* and 5*b*, sealing elements 5*a* and 5*b* will expand radially with great power, so that they are brought to abutment against an inner pipe wall, as shown in FIG. 1B and/or FIG. 2B.

Figure 4A:
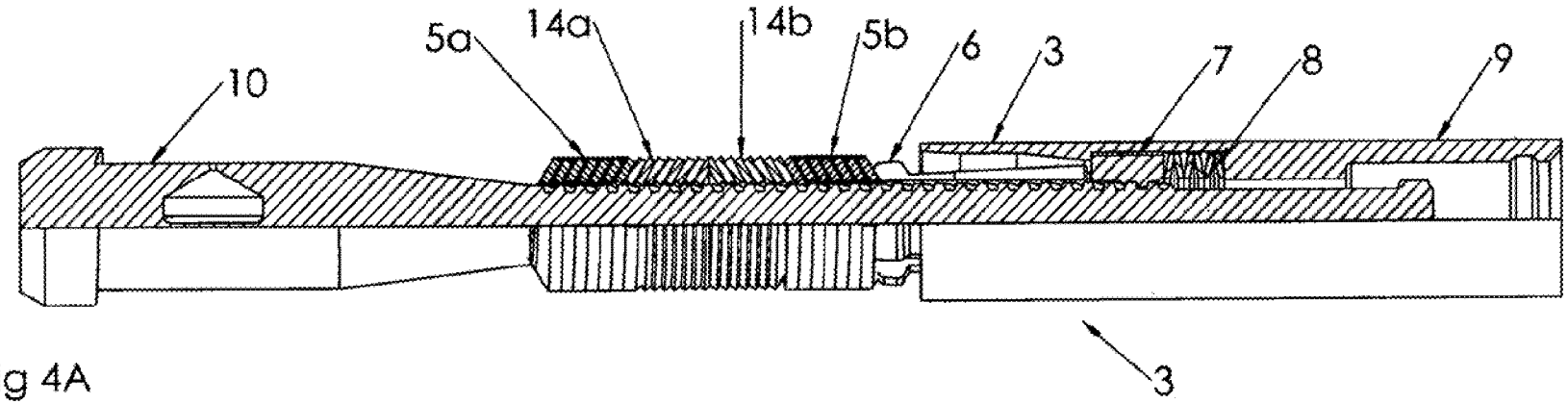
FIGS. 4A and 4B are similar to FIGS. 3A-C, but in addition, an anchoring system 14*a* and 14*b*, also implemented as helical elements, being integrated in the helical elements 5*a* and 5*b*, has been introduced.
Figure 4B:
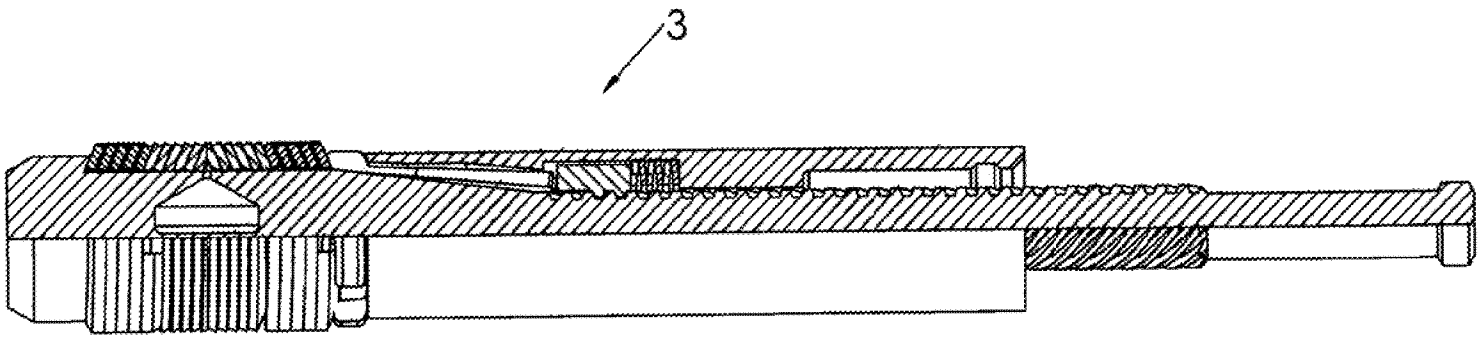

FIGS. 4A and 4B are similar to FIGS. 3A and 3B, but additionally, anchoring elements 14*a* and 14*b* are introduced together with sealing elements 5*a* and 5*b*. The first end winding of anchoring element 14*a* engages the end winding of 5*a*, the first start winding of anchoring element 14*b* engages the second end winding of anchoring element 14*a*, and end winding of 5*b* engages the second end winding of 14*b*.

Figure 5A:
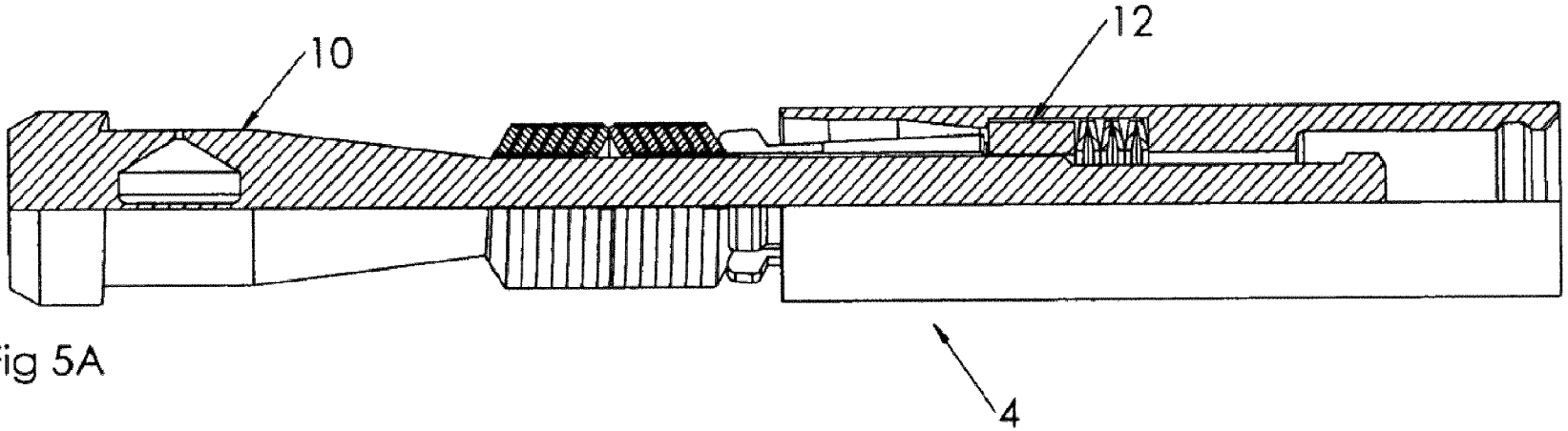
FIGS. 5A and 5B show an alternative embodiment to the embodiment shown in FIG. 3.
Figure 5B:
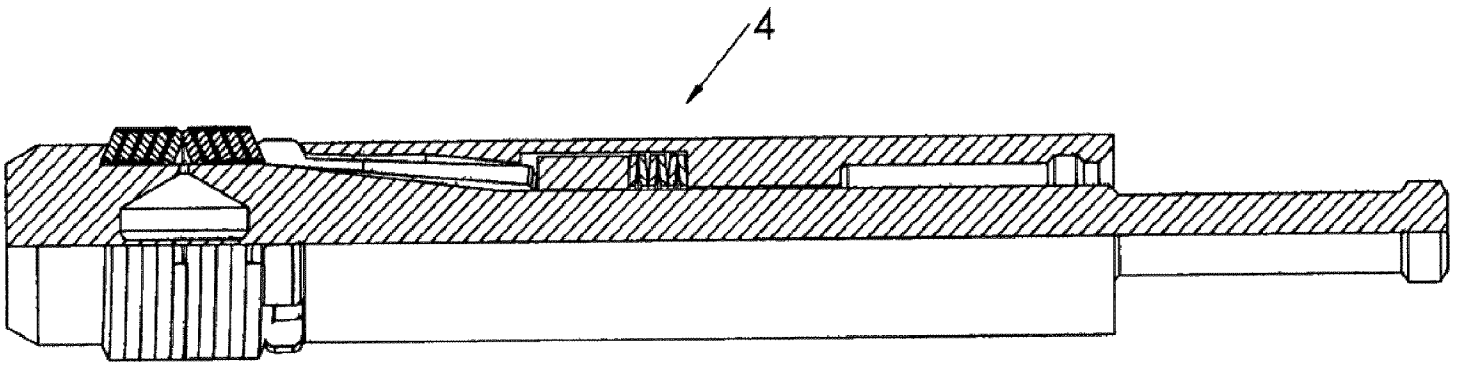

FIGS. 5A and 5B show an alternative design of a plug 4, similar to the one shown in FIGS. 3A and 3B, but the plug 5 has not undergone a relative rotation. A string section 10 and a bearing body 12 don't each include a thread cogging facing each other. In this embodiment, only an axial push force provides for the sealing elements 5*a* and 5*b* to climb and expand up the conical part of string section 10.

Figure 6A:
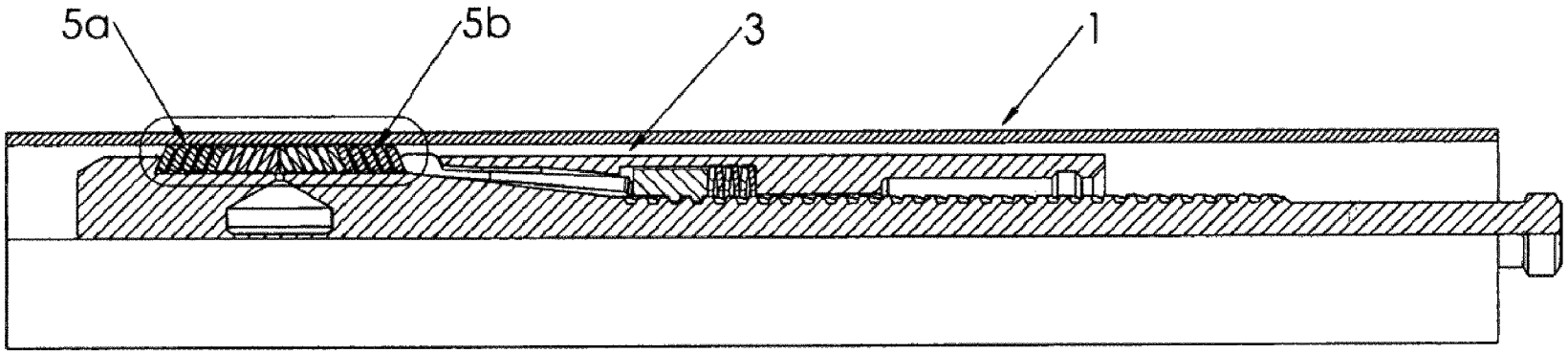
FIGS. 6A and 6B show details of an embodiment of helical elements 5*a* and 5*b*, wherein this embodiment also includes an integrated anchoring system 14*a* and 14*b*.

FIG. 6 details the configuration and operation of an exemplary embodiment of sealing elements 5*a* and 5*b*. This exemplary embodiment also includes anchoring elements 14*a* and 14*b*. Sealing elements 5*a* and 5*b* and anchoring elements 14*a* and 14*b* are pushed up the conical part of string section 10, causing sealing elements 5*a* and 5*b* and anchoring elements 14*a* and 14*b* to expand. When an additional, large axially directed compressive force is then applied to the elements between string section 10 and a compression sleeve 3, the gap to the inner wall of pipe 1 is closed, and the axial compressive force will be converted to a radial expanding force acting against the inner wall of pipe 1.

Figure 6B:
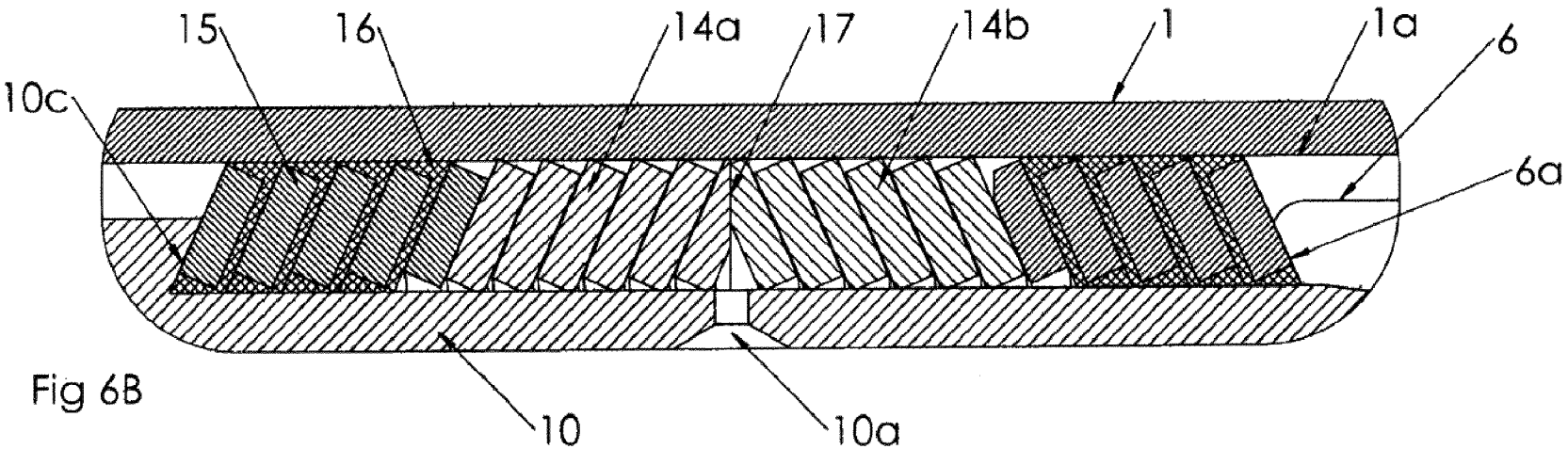

FIG. 6B shows that sealing elements 5*a* and 5*b* are comprised by a helical body 15 embedded in a suitable sealing material 16. The embedding is formed so that three sides of the wire cross section of the helical element (It is assumed here that the wire cross section is rectangular, although it is understood that other wire cross sections also may be used) is covered as shown, whereas the fourth side is not covered. Thus, the embedded helical element will still be able to act as a spiral, with each winding being separable from the others. The helical body 15 may be made of a common steel material, for example, but it is understood that other suitable materials may be used. Further, the sealing material 16 is advantageously arranged in such a manner that the helical body 15 does not contact string section 10 or the inside of pipe 1, as preferably only the sealing material 16 is to contact these elements. This eliminates the possibility that the relatively hard spiral may get stuck or cause the formation of scratches in string section 10 and/or the interior of pipe 1. It is also necessary to be able to allow for a certain axial relative movement between the interior of pipe 1 and the windings of sealing elements 5*a* and 5*b*, so that a substantially complete compression of sealing elements 5*a* and 5*b* can be achieved while the height of the helical elements changes.

When an axial compressive force is exerted on sealing elements 5*a* and 5*b* and anchoring elements 14*a* and 14*b* as contact faces 10*c* and 6*a* at their respective ends are pressed towards each other, contact faces 17 between anchoring elements 14*a* and 14*b* will serve as a tilting point so that the preferably rectangular, slightly sloping windings of the helical elements are caused to rise to thereby adapt to the reduced available volume. The sealing material 16 will be pressed and partially deformed against the inside of pipe 1, as the compressive forces will increase. This increase of the compressive forces will depend on the ratio of the width and height of the wire cross section, as a lever effect will arise causing very large compressive stresses in certain regions of the sealing material 16. The large compressive stresses causes parts of sealing material 16 to experience a state of yield, causing the sealing material to spread out and migrate into any damages and scratches in the pipe and fill any ovalities etc. in the inner wall of pipe 1.

For anchoring elements 14*a* and 14*b*, the same lever effect will arise, but in this case it is desirable for the spiral material of anchoring elements 14*a* and 14*b* to migrate into the inner wall of pipe 1 to thereby get a firm grip therein. However, it is not desirable for the anchoring elements 14*a* and 14*b* to shear stuck into in string section 10, as this may cause problems on a subsequent release.

A chamber 10*a* is provided in string section 10 in order to allow for a further fixing of sealing elements 5*a* and 5*b* after a pressure tight connection has been achieved. Chamber 10*a* is filled with an at least partially elastic liquid, and the elasticity of this liquid volume must be sufficient to ensure that the pressure build-up does not excessively hamper the setting function of the sealing and optionally anchoring elements. As an alternative, if desirable, a pressure tight chamber that is filled with a gas of sufficiently low pressure could be provided, with this pressure tight chamber communicating with chamber 10*a* via a shear plate. When sealing elements 5*a* and 5*b* are set, the failure point of the shear plate will be exceeded, causing any hydrostatic well pressure to provide an additional pull during the setting process.

According to an embodiment, the release of sealing elements 5*a* and 5*b* and/or anchoring elements 14*a* and 14*b* are accomplished by pulling in adapter sleeve 9 using a suitable pulling tool by way of profile 9*a*. With that, the spiral windings of sealing elements 5*a* and 5*b* and/or anchoring elements 14*a* and 14*b* will pull out, winding by winding, until sealing elements 5*a* and 5*b* and/or anchoring elements 14*a* and 14*b* let go of the interior of pipe 1. Then, a compressive force may be applied to string section 10 by means of a profiled end 10*b*, so that sealing elements 5*a* and 5*b* and anchoring elements 14*a* and 14*b* are run back all the way down the conical part of string section 10 to return to the starting position.

The fundamental principle of the invention is based on the relation between the circumferential diameter of a cylindrical spiral, the number of windings, the longitudinal extent (the spiral slope), as well as the spiral length along its curve from the start point to the end point thereof. Somewhat simplified, the relation may be determined based on a circle, with one winding of the spiral being represented by this circle. I the case of a wire of length L wound to a spiral comprising n windings, the spiral having a circumferential diameter D, the relation between these quantities may be roughly described as:

$$L=\Pi*D*n$$

From the above, it can be seen that if, using the same wire, a spiral comprising n+1 windings is wound, then D must reduce since L is unchanged. In general, a larger number of windings will result in a smaller circumferential diameter for a spiral of constant wire length L. Conversely, a smaller number of windings will result in a larger circumferential diameter for the same wire length L.

As the actual configuration is a spiral, it will be necessary to correct for the effect of the spiral slope on the circumferential diameter of the spiral. This is because an actual spiral being wound of an actual wire, need to have a minimum slope corresponding to the wire thickness. The formula below describes the relation between the spiral radius, R, spiral wire length, L, for one slope length, as well as the extent of the spiral in the longitudinal direction of a winding, d.

$$R=\sqrt{\frac{L-d}{2\Pi}}$$

(Applies for one slope length)

The above formula also applies for slopes larger than 1 wire thickness.

It is seen that if d increases, R must reduce when L remains constant. This means that by stretching a spiral in the longitudinal direction, a reduction in the circumferential diameter thereof will be achieved.

FIGS. 8A through 8D illustrate how a spiral will change with a change in the number of windings.

Figure 8B:
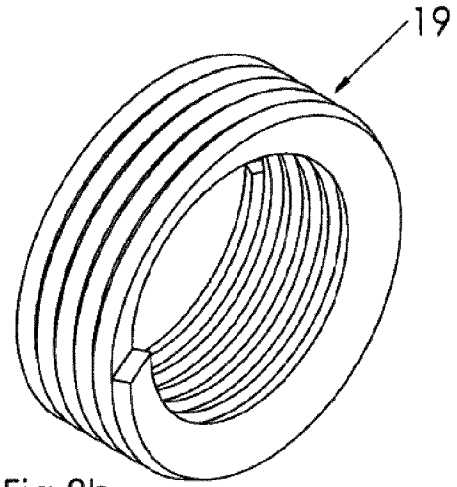
FIGS. 8A-8D show how a coil spring will change when the number of windings are changed.
Figure 8D:
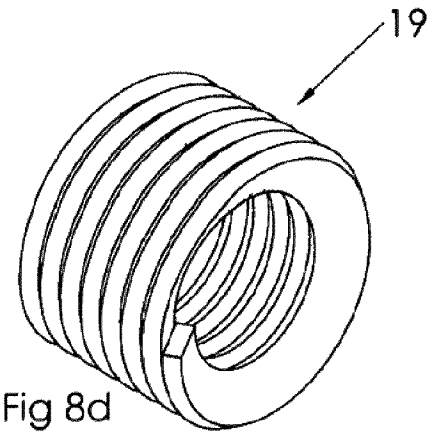
Figure 8A:
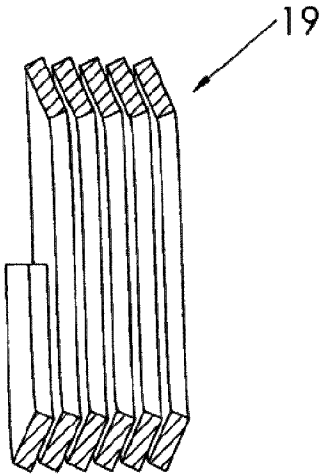

FIGS. 8A and 8B show a spiral 19 comprising 5.5 windings. It can be seen that the length thereof have to increase if the slope remains constant, e.g. silent length (wire against wire), while the number of windings is increased. This is shown in FIGS. 8C and 8D, in which the number of windings has been increased to 7.5.

Figure 8C:
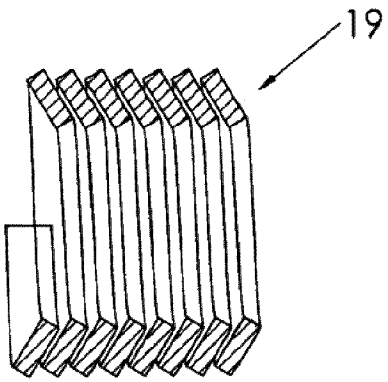

Also, a reduction of the circumferential diameter of the spiral can be seen in FIGS. 8C and 8D, as compared to FIGS. 8A and 8B.

According to the present invention, helical elements are used to allow for an expansion corresponding to the one described above, that is, an increase of the circumferential diameter of a helical element, as a helical element has the unique property of being able to expand a large radial length outwardly without exceeding the tensile strength of neither the helical element nor the sealing material. Hence, sealing elements and/or anchoring elements are provided that may assist in providing a highly expanding metal-to-metal sealing and anchoring system, among other things. Moreover, this principle may also be used for providing more common elastomer sealing systems. According to one embodiment, the helical elements may be formed of another material than the sealing material, in which case the sealing material may be fixed to the spiral by gluing or casting.

The helical elements 5*a*, 5*b*, 14*a*, 14*b* may also be made of a so-called memory metal, such as Nitinol, for example, so that the helical element, when heated or experiencing a temperature change, e.g. due to the application of an electric current across the helical element, will expand as described above without the use of a mandrel device and/or a screw force. Thereafter, the spiral may be axially compressed in the same manner as described by means of the compression sleeve 9 and a contact surface 10*a*, or the like.

It is understood that a functional sealing device according to the present invention also should include a sealing material that seals between each winding of the helical elements 5*a*, 5*b*, 14*a*, 14*b*, as well as against string section 10. Any sealing material 16 provided on the helical elements 5*a*, 5*b*, 14*a*, 14*b* should be properly attached, and the surfaces of the helical elements 5*a*, 5*b*, 14*a*, 14*b* may typically be grooved or otherwise adapted to provide an adequate grip for the sealing material 16. As an alternative, end stops may also be provided on the helical elements 5*a*, 5*b*, 14*a*, 14*b*, so that the sealing material 16 has a strong abutment to bear against should it start sliding along the helical elements 5*a*, 5*b*, 14*a*, 14*b*.

The invention claimed is:

1. A sealing and anchoring element for use in pipelines, said element comprising:

a string section; and a plurality of helical elements, at least one helical element of said plurality of helical elements being arranged around said string section, wherein said at least one helical element is configured to expand radially against an inner wall of a pipeline so that the circumferential diameter of said at least one helical element is increased, wherein two helical elements of said plurality of helical elements are arranged to form substantially rectangular, sloping windings, and said substantially rectangular, sloping windings are arranged so as to face each other and are further configured to rise and expand radially to thereby reduce space in the pipeline when an axial compressive force is applied to said two helical elements to cause said two helical elements to form a seal between said two helical elements and the inner wall of the pipeline and migrate into the inner wall of the pipeline to thereby obtain a firm grip therein, and wherein said string section comprises a conical part having a first side and a second side, a circumference of said string section on said first side of said conical part being sized and configured such that the circumferential diameter of said at least one helical element is the same as or less than the circumferential diameter of a compression sleeve, said compression sleeve being arranged around a narrower end of said string section and on one side of said at least one helical element, the circumference of said string section on said second side of said conical part being thicker than the first side such that the circumferential diameter of said at least one helical element is expanded radially towards the inner wall of the pipeline when said at least one helical element is forced across a thicker end of said string section, said thicker end having an abutment face, and said at least one helical element being configured to expand further while being compressed between said compression sleeve and said abutment face of said thicker end of said string section.

2. The sealing and anchoring element of claim 1, wherein said at least one helical element is configured to form a metal-to-metal seal between said at least one helical element and the inner wall of the pipeline.

3. The sealing and anchoring element of claim 2, wherein said string section includes a device configured to increase the circumferential diameter of said at least one helical element so that said at least one helical element expands radially towards the inner wall of the pipeline.

4. The sealing and anchoring element of claim 2, wherein said at least one helical element is a memory metal, so that upon an outer influence, said at least one helical element is expanded radially towards the inner wall of the pipeline.

5. The sealing and anchoring element of claim 1, wherein said at least one helical element is configured to form an elastomer seal between said at least one helical element and the inner wall of the pipeline.

6. The sealing and anchoring element of claim 5, the wherein said string section includes a device configured to increase the circumferential diameter of said at least one helical element so that said at least one helical element expands radially towards the inner wall of the pipeline.

7. The sealing and anchoring element of claim 5, wherein said at least one helical element is a memory metal, so that upon an outer influence, said at least one helical element is expanded radially towards the inner wall of the pipeline.

8. The sealing and anchoring element of claim 1, wherein said string section includes a device configured to increase the circumferential diameter of said at least one helical element so that said at least one helical element expands radially towards the inner wall of the pipeline.

9. The sealing and anchoring element of claim 1, wherein said at least one helical element is a memory metal, so that upon an outer influence, said at least one helical element is expanded radially towards the inner wall of the pipeline.

10. The sealing and/or anchoring element of claim 9, wherein said memory metal comprises Nitinol, and the outer influence includes heating or application of an electric current.

11. The sealing and anchoring element of claim 1, wherein said at least one helical element is configured to expand further as said at least one helical element is compressed in an axial direction.

12. The sealing and/or anchoring element of claim 11, wherein said at least one helical element is configured to be compressed in an axial direction by a clamping device on each side of said at least one helical element .

13. The sealing and anchoring element of claim 12, wherein said at least one helical element is configured to be compressed in an axial direction between said compression sleeve and said abutment face.

14. The sealing and anchoring element of claim 1, wherein said string section comprises a device configured to increase the circumferential diameter of said string section to cause said at least one helical element to expand radially towards the inner wall of the pipeline.

15. The sealing and anchoring element of claim 1, wherein said at least one helical element is a metal material.

16. The sealing and anchoring element of claim 15, wherein said at least one helical element is embedded into or coated by a sealing material.

17. The sealing and anchoring element of claim 16, wherein said sealing material comprises an elastomer material.

18. The sealing and anchoring element of claim 15, wherein said at least one metal helical element comprises one or more outer layers of a metal material softer than the metal material of at least one inner layer of said at least one metal helical element.

19. A sealing and anchoring element for use in pipelines, said element comprising:

a string section; and a plurality of helical elements, at least one helical element of said plurality of helical elements being arranged around a string section, wherein said at least one helical element is configured to expand radially against an inner wall of a pipeline so that the circumferential diameter of the at least one helical element is increased, wherein two helical elements of a said plurality of helical elements are arranged to form substantially rectangular, sloping windings, and said substantially rectangular, sloping windings being arranged to face each other, and are further configured to rise and expand radially to thereby reduced space in the pipeline when an axial compressive force is applied to said two helical elements, and wherein said at least one helical element is a memory metal, so that upon an outer influence, said at least one helical element is expanded radially towards the inner wall of the pipeline, and wherein said string section comprises a conical part having a first side and a second side, a circumference of said string section on said first side of said conical part being sized and configured such that the circumferential diameter of said at least one helical element is the same as or less than the circumferential diameter of a compression sleeve, said compression sleeve being arranged around a narrower end of said string section and on one side of said at least one helical element, the circumference of said string section on said second side of said conical part being thicker than said first side such that the circumferential diameter of said at least one helical element is expanded radially towards the inner wall of the pipeline when said at least one helical element is forced across a thicker end of said string section, said thicker end having an abutment face, and said at least one helical element being configured to expand further while being compressed between said compression sleeve and said abutment face of said thicker end of said string section.

20. The sealing and anchoring element of claim 19, wherein said at least one helical element is configured to form a metal-to-metal seal between said at least one helical element and the inner wall of the pipeline.

21. The sealing and anchoring element of claim 20, wherein said string section includes a device configured to increase the circumferential diameter of said at least one helical element so that said at least one helical element expands radially towards the inner wall of the pipeline.

22. The sealing and anchoring element of claim 19, wherein said at least one helical element is configured to form an elastomer seal between said at least one helical element and the inner wall of the pipeline.

23. The sealing and anchoring element of claim 22, wherein said string section includes a device configured to increase the circumferential diameter of said at least one helical element so that said at least one helical element expands radially towards the inner wall of the pipeline.

24. The sealing and anchoring element of claim 19, wherein said string section includes a device configured to increase the circumferential diameter of said at least one helical element so that said at least one helical element expands radially towards the inner wall of the pipeline.

25. The sealing and anchoring element of claim 19, wherein said memory metal comprises Nitinol, and that the outer influence includes heating or application of an electric current.

26. The sealing and anchoring element of claim 19, wherein said at least one helical element is configured to expand further as said at least one helical element is compressed in an axial direction.

27. The sealing and anchoring element of claim 26, wherein said at least one helical element is compressed in an axial direction by a clamping device on each side of said at least one helical element.

28. The sealing and anchoring element of claim 27, wherein said at least one helical element is configured to be compressed in an axial direction between said compression sleeve and said abutment face.

29. The sealing and anchoring element of claim 19, wherein said string section comprises a device configured to increase the circumferential diameter of said string section so as to cause said at least one helical element to expand radially towards the inner wall of the pipeline.

30. The sealing and anchoring element of claim 19, wherein said at least one helical element is a metal material and is embedded into or coated by a sealing material.

31. The sealing and anchoring element of claim 30, wherein said sealing material comprises an elastomer material.

* * * * *